US008235380B2

(12) United States Patent
Claris

(10) Patent No.: US 8,235,380 B2
(45) Date of Patent: Aug. 7, 2012

(54) MAILPIECE SELECTOR DEVICE HAVING IMPROVED LEVERS

(75) Inventor: Yannick Claris, Fontenay Aux Roses (FR)

(73) Assignee: Neopost Technologies, Bagneux (FR)

( * ) Notice: Subject to any disclaimer, the term of this patent is extended or adjusted under 35 U.S.C. 154(b) by 0 days.

(21) Appl. No.: 12/913,545

(22) Filed: Oct. 27, 2010

(65) Prior Publication Data

US 2011/0121507 A1 May 26, 2011

(30) Foreign Application Priority Data

Oct. 28, 2009 (FR) ..... 09 57576

(51) Int. Cl.
*B65H 3/06* (2006.01)

(52) U.S. Cl. ..... 271/131; 271/2; 271/137; 271/119

(58) Field of Classification Search ..... 271/2, 35, 271/110, 121, 124, 131, 137, 119
See application file for complete search history.

(56) References Cited

U.S. PATENT DOCUMENTS

| | | | | |
|---|---|---|---|---|
| 4,544,147 | A * | 10/1985 | Dinnissen | 271/35 |
| 4,715,593 | A * | 12/1987 | Godlewski | 271/10.11 |
| 4,978,114 | A * | 12/1990 | Holbrook | 271/35 |
| 5,601,282 | A | 2/1997 | Milo et al. | |
| 6,402,135 | B1 | 6/2002 | Werner | |
| 6,485,012 | B1 * | 11/2002 | Bakoledis | 271/35 |
| 6,971,645 | B2 * | 12/2005 | Coret et al. | 271/138 |
| 7,726,643 | B2 * | 6/2010 | Werner | 271/35 |
| 7,806,402 | B2 * | 10/2010 | Sato et al. | 271/165 |
| 7,850,163 | B2 * | 12/2010 | Kaiping | 271/35 |
| 2006/0220299 | A1 * | 10/2006 | Kaiping | 271/35 |
| 2008/0099977 | A1 * | 5/2008 | Salomon et al. | 271/35 |
| 2008/0179811 | A1 * | 7/2008 | Bernard et al. | 271/2 |
| 2009/0091073 | A1 * | 4/2009 | Joyce et al. | 271/4.02 |
| 2009/0134564 | A1 * | 5/2009 | Kaiping | 271/35 |

* cited by examiner

*Primary Examiner* — Kaitlin Joerger
(74) *Attorney, Agent, or Firm* — Sughrue Mion, PLLC

(57) ABSTRACT

A mailpiece selector device comprising a guide co-operating with at least one opposing selector roller to separate mailpieces one-by-one from a stack of mailpieces and to transport them downstream, said guide having at least one selector lever that can pivot about a pivot axis against resilient return means, and the selector lever having a vertical section formed by an involute of a circle, the base circle of which is formed by the pivot axis.

13 Claims, 2 Drawing Sheets

FIG.1
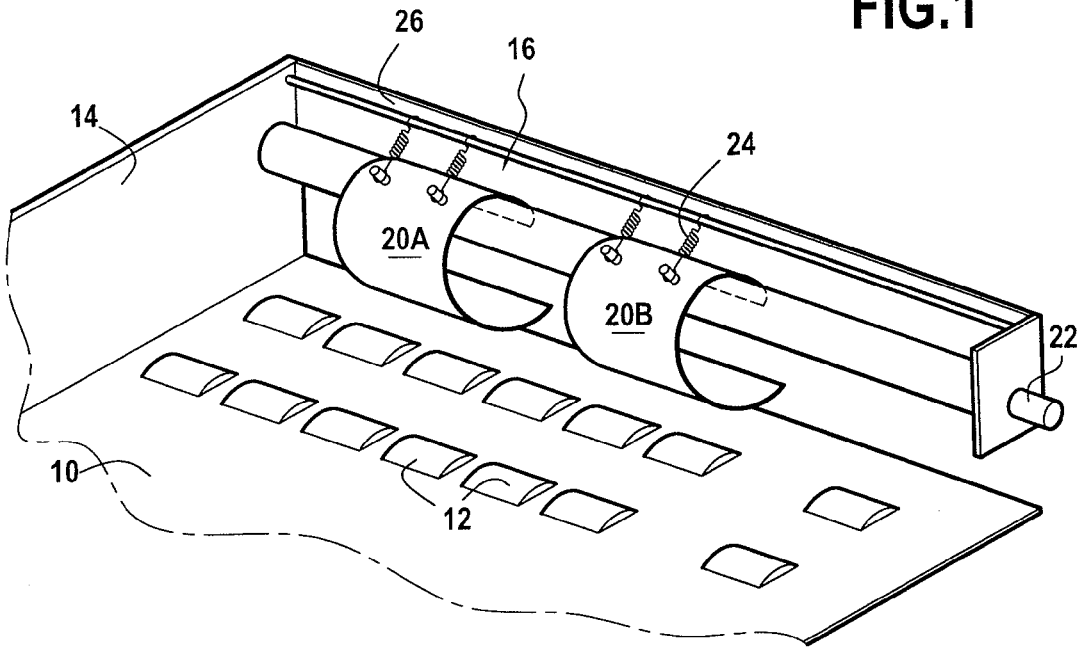
FIG.1A
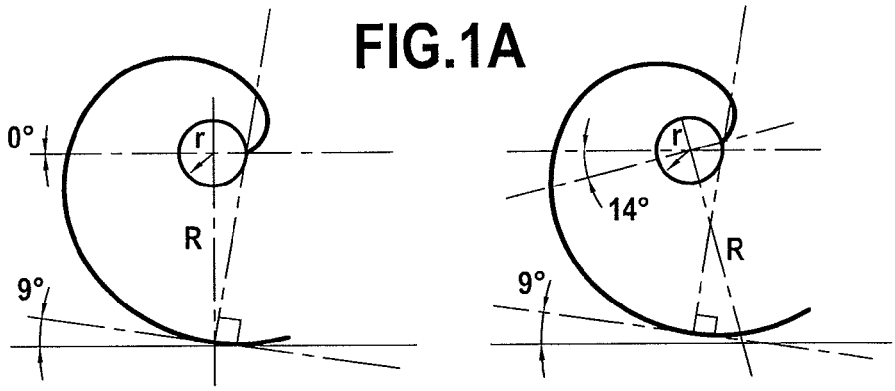
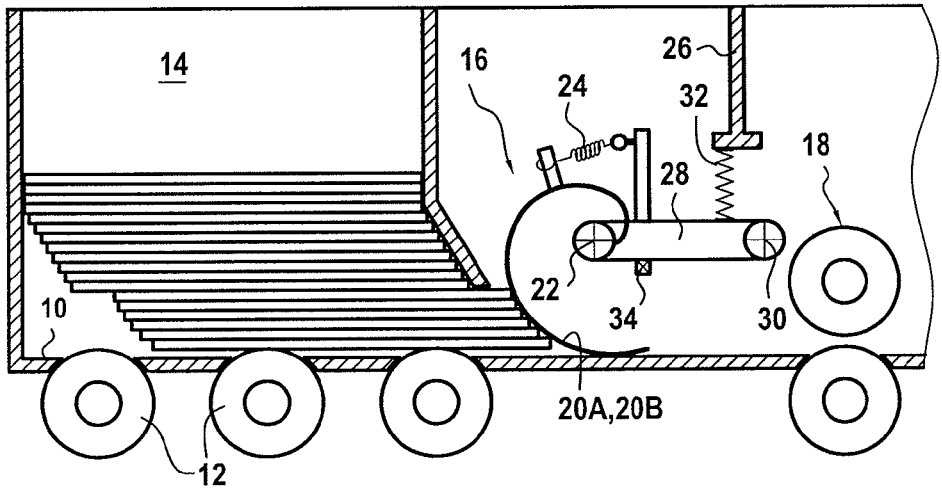
FIG.3

MAILPIECE SELECTOR DEVICE HAVING IMPROVED LEVERS

FIELD OF THE INVENTION

The present invention relates to the field of mail handling and it relates more particularly to a mailpiece selector device implemented in an automatic feed module or "feeder" of a franking machine or "postage meter" for franking mailpieces.

PRIOR ART

Conventionally, a franking machine needs to be adapted to receive various types of mailpiece, such as documents, letters, or envelopes of greater or lesser thickness, typically lying in the range 0.1 millimeters (mm) to 20 mm. To this end, on the upstream side, such a franking machine often includes an automatic feed module making it possible, in particular, to convey such mailpieces at various speeds. That automatic feed module usually includes means for receiving/stacking, selecting transporting, and possibly closing such mailpieces.

In particular, the selector means for selecting such mailpieces conventionally comprise a stationary inclined guide co-operating with opposing selector rollers to select the mailpieces one-by-one, and to transport them downstream. Those selector means must be capable of avoiding "double feeds" i.e. of preventing two or more mailpieces from being fed through together, so as to avoid some mailpieces being franked with erroneously-computed postage amounts, and other mailpieces not being franked. In U.S. Pat. No. 5,431,385, the guide is replaced with an inclined belt that, by moving in rotation, drives the mailpieces towards the selector rollers.

Those systems are generally satisfactory when the stack of mailpieces is uniform, i.e. with mailpieces of the same size and thickness, or placed from the thickest to the thinnest so that the thickest is at the bottom of the stack. Conversely, when the stack is not uniform and when, for example, a thick mailpiece overlies (succeeds) a mailpiece of smaller thickness, then it is the mailpiece of larger thickness that is the first one to come into engagement with the guide and not the thinner mailpiece, thereby frequently giving rise to a double feed. Similarly, when a plurality of mailpieces having very small thicknesses arrive together at the guide, it can happen that a conventional guide configuration does not make it possible for correct separation to be achieved.

OBJECT AND DEFINITION OF THE INVENTION

An object of the present invention is to mitigate the drawbacks resulting from double feeds of envelopes by proposing a mailpiece selector device for a feeder of a franking machine that can prevent such double feeds from occurring.

This object is achieved by a mailpiece selector device comprising a guide co-operating with at least one opposing selector roller to separate mailpieces one-by-one from a stack of mailpieces and to transport them downstream, said guide having at least one selector lever that can pivot about a pivot axis against resilient return means, wherein said selector lever has a vertical section formed by an involute of a circle.

Thus, the tangent of the lever at the point of contact with a mailpiece remains constant regardless of the thickness thereof, thereby making it possible to keep a constant funnel effect and thus improving the continuity of selection, and facilitating separation.

Advantageously, the base circle of said involute is formed by said pivot axis.

Preferably, the selector device may have a plurality of selector levers that can pivot independently from one another about said pivot axis. Said selector levers are positioned so that at least one of said selector levers comes into contact with said mailpiece in a zone extending from a midline of said mailpiece that is parallel to a referencing wall to a parallel edge of said mailpiece that is the edge that is further from said referencing wall of said mailpiece.

Advantageously, said selector lever is coated with a ceramic or with an elastomer.

The selector device of the invention may have two selector levers positioned respectively in the range 60 mm from said referencing wall to 85 mm therefrom and in the range 120 mm from said referencing wall to 150 mm therefrom. It may further have a third selector lever positioned in the range 180 mm from said referencing wall to 230 mm therefrom. Each of said levers preferably has a width of about 10 mm.

In accordance with desired embodiments, said common pivot axis can be stationary, said selector lever pivoting through in the range 0° to about 108°, or can be articulated at an end of a suspension arm that can pivot about a fixed axis against resilient return means, said selector lever pivoting through in the range 0° to about 30° and said suspension arm pivoting through in the range 0° to about 45°.

The invention also provides a mailpiece feeder for a franking machine, which feeder includes a mailpiece selector device as mentioned above.

BRIEF DESCRIPTION OF THE DRAWINGS

Other characteristics and advantages of the present invention appear more clearly from the following description given by way of non-limiting indication and with reference to the accompanying drawings, in which:

FIG. 1 is a perspective view of a preferred embodiment of the mailpiece selector device of the invention;

FIG. 1A shows, in two positions, the feature of the selector lever of the device having the shape of an involute of a circle;

FIG. 3 is an alternative embodiment of the mailpiece selector device of the invention.

DETAILED DESCRIPTION OF A PREFERRED EMBODIMENT OF THE INVENTION

Figure 2A:
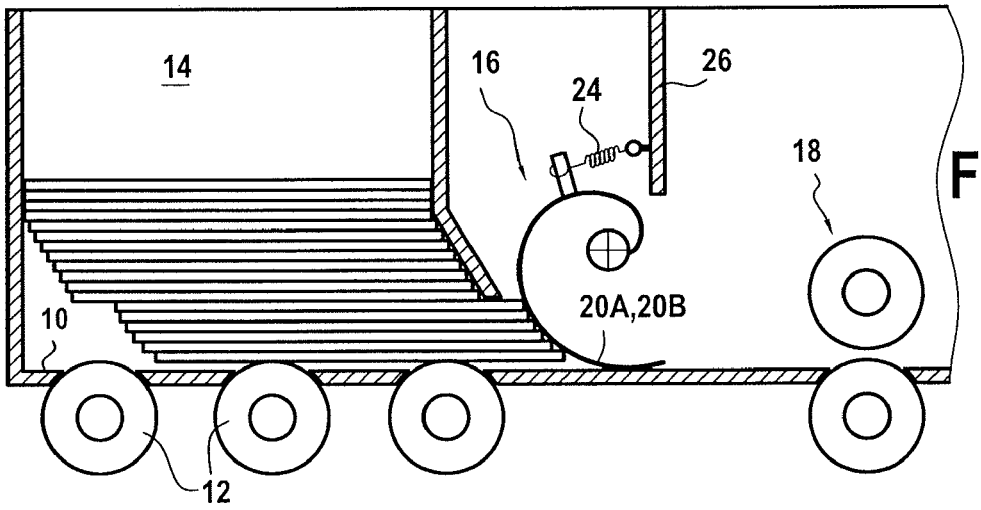
FIGS. 2A, 2B, and 2C show the selector device of FIG. 1 respectively in an initial rest position and in a subsequent position before and after selection of a mailpiece.

As shown in FIG. 1, an automatic mailpiece feed module conventionally has a feed zone formed essentially by a deck 10 designed to receive a stack of mailpieces and including first transport rollers 12 for driving the mailpieces downstream (and against a referencing wall 14) at a separation zone having a separator device 16 in which the mailpieces are extracted one by one from the stack of mailpieces. Second transport rollers (referenced 18 in FIGS. 2A to 2C) are, in general, provided at the outlet of said separation zone for the purpose of conveying the mailpieces extracted in this way downstream.

In accordance with the invention, the mailpiece selector device is not constituted conventionally by a stationary inclined guide (a comb with stationary teeth) having a straight section, or by an inclined belt, as described in the patent cited in the introduction above, co-operating with a plurality of opposing selector rollers for selecting a single mailpiece only and for transporting it downstream, but rather, the mailpiece selector device is constituted by a guide having at least one selector lever 20A, 20B having a vertical section in the shape of an involute of a circle. In addition, the lever(s) is/are movable, i.e. they are hinged independently from one another about a common pivot axis 22, and, each time a mailpiece passes over the selector rollers, each of said levers can pivot against resilient return means, e.g. a traction spring 24 having one of its ends secured to the selector lever, and its other end in abutment against a framework portion 26 of the selector device.

However, it should be noted that although reference is made to a traction spring, by way of example, naturally a torsion or compression spring may also be suitable, subject to the spring being fastened to the framework in a different fastening configuration, or indeed any other analogous return means may be suitable.

Each selector lever 20A, 20B may be made of an elastomer material having a very high coefficient of friction so as to procure the best possible contact with the mailpiece, or indeed may be made of a ceramic material that offers the advantage, compared with elastomer, of not wearing and of not leaving marks on the mailpieces.

In the example shown, the selector device has two selector levers 20A, 20B, the width of which must be sufficient to ensure that the mailpiece is engaged properly, e.g. the width must be ⅔ of the smallest mailpiece format, i.e. about 60 mm, these two levers being distributed over the width of the device so as to enable most allowable formats to be selected under the best possible conditions. An alternative is to place two selector levers having a width of about 10 mm and positioned respectively in the range 60 mm from the referencing to 85 mm therefrom, and in the range 120 mm from said referencing wall to 150 mm therefrom. The lever that is 60 mm from the referencing wall makes it possible to select mailpieces having widths in the range 85 mm to 114 mm, by having a selection point (point of contact between the lever and the mailpiece) positioned in a zone of the mailpiece that corresponds to its half that is further away from the referencing wall, the second lever at 120 mm making it possible to select mailpieces having widths in the range 152 mm to 310 mm with two selection points. Finally, in another alternative, a third selector lever placed in the range 180 mm from the referencing wall to 230 mm therefrom may be added to the two preceding levers in order to make it possible also to select, in optimum manner, mailpieces having a width of 324 mm.

By positioning the selection point(s) in the second half of the mailpiece (the zone extending from the midline of the mailpiece that is parallel to the referencing wall to the parallel edge that is further from said referencing wall) makes it possible to avoid the mailpiece pivoting on being selected. If the mailpiece starts to pivot about the selection point (and if said selection point is positioned in the second half of the mailpiece), then when the mailpiece comes into contact with said selection point, the referencing wall tends to prevent such pivoting. Whereas, if the selection point is positioned in the first half of the mailpiece, such pivoting is not prevented.

Naturally, this configuration is in no way limiting, and various numbers of levers are possible, e.g. from one to five. When the lever is a single lever, it is disposed over almost the entire width of the device in a manner similar to a conventional guide. Conversely, when there are multiple selector levers, they can be as numerous as the teeth of a conventional guide and then spaced apart in similar manner. However, a configuration with three levers having a width of 10 mm and with a first lever situated 60 mm from the referencing wall, a second lever 120 mm therefrom, and a third 180 mm therefrom makes it possible to process the most common mailpiece formats.

FIG. 1A shows a selector lever in section, firstly in its initial position (left drawing) and secondly in its selection position, while a mailpiece is passing through (right drawing). In the example shown, the base circle for the involute (that corresponds to the common axis 22) has a radius r of 7 mm and the vertical R passing through the center of this circle has a length of 39.9 mm. In the rest first position, the angle between the involute to the circle and its tangent is then 9° and this angle is constant regardless of the pivoting of the lever so that it thus finds itself in the second position even though the lever has pivoted through 14°, corresponding to a mailpiece having a thickness of about 2 mm passing through. It should be noted that, for a mailpiece having a thickness of 20 mm, this pivoting angle would be about 108°.

Figure 2B:
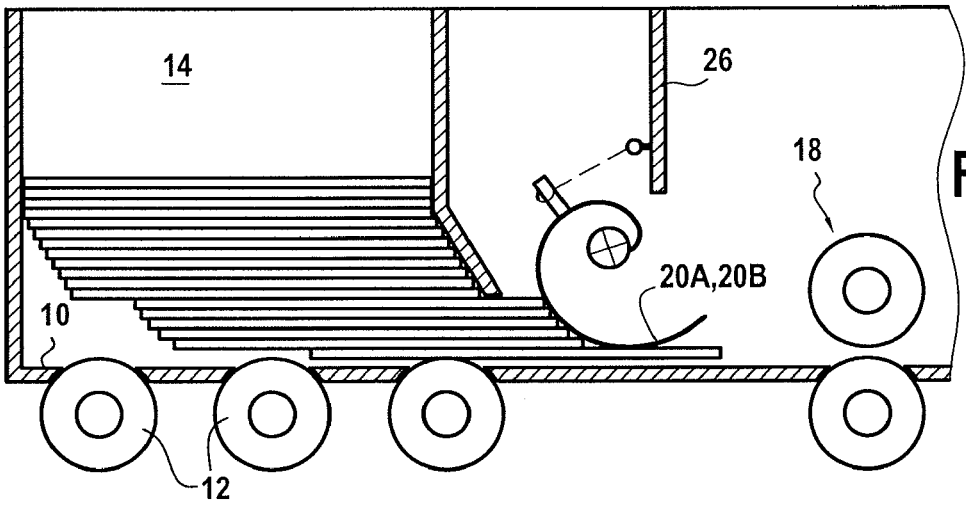
Figure 2C:
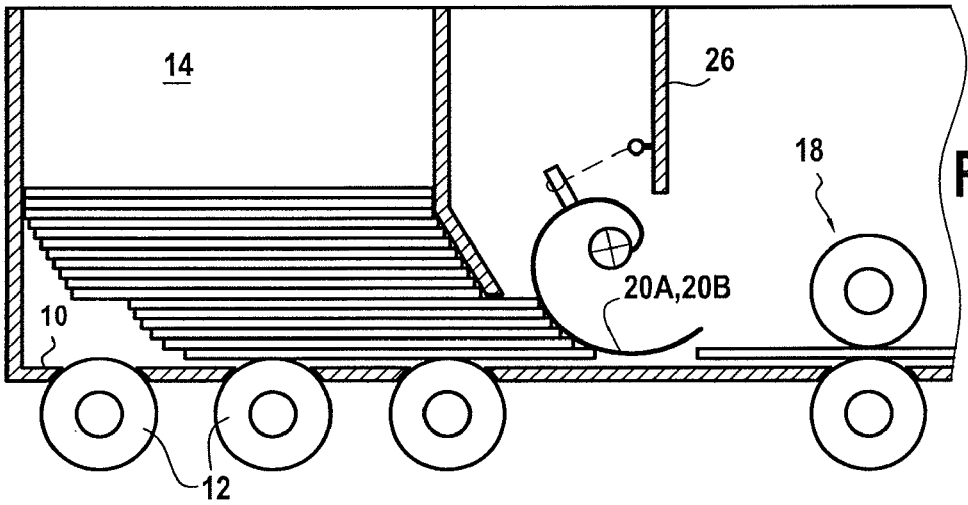

Operation of the selector device of the invention as shown mainly with reference to FIGS. 2A to 2C, is as follows. In FIG. 2A, the mailpieces to be processed are dumped as they come (i.e. as in a stack of mixed mail) on the feed deck 10, and are in contact with the guide. In FIG. 2B, the effect of the action of the feed rollers 12 is to drive the first mailpiece at the bottom of the stack that then pushes the selector lever, thereby causing said mailpiece to be moved downstream. In FIG. 2C, the mailpiece has been selected and the selector lever is therefore going to move back into its initial position under the effect of the force exerted by the traction spring 22. It should be noted that this return force is not constant. The greater the extent of the pivoting of the lever, the larger the force itself must be. And, in particular, the return force that is at its maximum for the separation (FIG. 2B), must, when the lever is in the return position (FIG. 2C), be greater than when the lever is in its initial position (FIG. 2A).

It has been yet observed that when thick mailpieces push the selector levers 20A, 20B, and thus make them to rotate of an important angle (for instance higher than 60°), the return in their rest position could induce the creases of the following envelopes, particularly if they are thin. In order to avoid this phenomenon, it is proposed in an alternative embodiment of FIG. 3 to limit the rotation of the selector levers (for example around 30°) and to permit a further vertical displacement by adding a second degree of liberty. To this end, the common pivot axis 22 of the levers is no longer stationary and secured to the framework 26 but articulated at an end of a suspension arm 28 that can pivot of an angle from 0° to 45° about a fixed axis 30 secured to the framework and against resilient return means, for example a compression spring 32 having one of its ends secured to the suspension arm, and its other end in abutment against the framework. An end stop 34 defines the rest position of the suspension arm which is now used as abutment for the second end of the traction spring 24 instead of the framework 26.

With this embodiment, for mailpieces of low thickness, the suspension arm pressed by the compression spring is in abutment and only selector levers are active. In contrast, when a mailpiece of high thickness arises under the selector levers, it will grow until they are in abutment with the suspension arm and according to its thickness will also bring a pivot of this arm that will lift the selector levers. Once passed, the arm will return to its rest position and the selector levers also but their rotation is then limited to their maximum excursion defined by their prior stop against the suspension arm.

Thus, with the present invention, it is possible for mailpieces of various thicknesses to be processed automatically without selecting any particular operating mode by means of a special lever, as is often necessary in many prior art devices.

In addition, the special shape of the selector levers, with each of them being in the shape of an involute of a circle, makes it possible not to change the conditions of the contact point when processing mailpieces of small thickness.

What is claimed is:

1. A mailpiece selector device comprising:

a guide to separate mailpieces one-by-one from a stack of mailpieces, said guide having at least one selector lever that is pivotal about a pivot axis against resilient return means, wherein said selector lever has a vertical section formed by an involute of a circle; and a roller, opposing the guide, for transporting the separated mailpiece downstream.

2. A mailpiece selector device according to claim 1, wherein the base circle of said involute is formed by said pivot axis.

3. A mailpiece selector device according to claim 1, having a plurality of selector levers that can pivot independently from one another about said pivot axis.

4. A mailpiece selector device according to claim 3, wherein said selector levers are positioned so that at least one of said selector levers comes into contact with said mailpiece in a zone extending from a midline of said mailpiece that is parallel to a referencing wall to a parallel edge of said mailpiece that is the edge that is further from said referencing wall of said mailpiece.

5. A mailpiece selector device according to claim 4, having two selector levers positioned respectively in the range 60 mm from said referencing wall to 85 mm therefrom and in the range 120 mm from said referencing wall to 150 mm therefrom.

6. A mailpiece selector device according to claim 5, further having a third selector lever positioned in the range 180 mm from said referencing wall to 230 mm therefrom.

7. A mailpiece selector device according to claim 5, wherein each of said levers has a width of about 10 mm.

8. A mailpiece selector device according to claim 1, wherein said selector lever is coated with a ceramic or with an elastomer.

9. A mailpiece selector device according to claim 1, wherein said common pivot axis is stationary.

10. A mailpiece selector device according to claim 9, wherein said selector lever pivots through in the range 0° to about 108°.

11. A mailpiece selector device according to claim 1, wherein said common pivot axis is articulated at an end of a suspension arm (28) that can pivot about a fixed axis (30) against resilient return means (32).

12. A mailpiece selector device according to claim 9, wherein said selector lever pivots through in the range 0° to about 30° and said suspension arm pivots through in the range 0° to about 45°.

13. A mailpiece feeder for a franking machine, which feeder includes a mailpiece selector device according to claim 1.

* * * * *